United States Patent [19]

Burwell

[11] Patent Number: 4,795,091

[45] **Date of Patent: * Jan. 3, 1989**

[54] ADJUSTABLE RAILWAY FASTENING

[75] Inventor: Gar W. N. Burwell, Madison, N.J.

[73] Assignee: Rails Company, Maplewood, N.J.

[ * ] Notice: The portion of the term of this patent subsequent to Aug. 18, 2004 has been disclaimed.

[21] Appl. No.: 61,101

[22] Filed: Jun. 10, 1987

Related U.S. Application Data

[63] Continuation-in-part of Ser. No. 845,486, Mar. 28, 1986, Pat. No. 4,687,134, which is a continuation of Ser. No. 314,557, Oct. 26, 1981, abandoned.

[51] Int. Cl.[4] ..... E01D 19/12; E01B 9/30

[52] U.S. Cl. ..... 238/349; 238/26; 238/310

[58] Field of Search ..... 238/1, 26, 217, 310, 238/338, 342, 349, 351; 14/73, 74; 403/3, 4, 380, 388, 408.1

[56] References Cited

U.S. PATENT DOCUMENTS

| | | | |
|---|---|---|---|
| 3,362,639 | 1/1968 | Van Sant | 238/349 |
| 3,552,649 | 1/1971 | Burwell | 238/349 |
| 3,659,784 | 5/1972 | Klosk | 238/349 |
| 3,796,369 | 3/1974 | Favil | 238/349 |
| 4,254,909 | 3/1981 | Rex | 238/349 X |
| 4,561,589 | 12/1985 | Hixson | 238/297 |
| 4,687,134 | 8/1987 | Burwell | 238/349 |

*Primary Examiner*—Leonard E. Smith
*Assistant Examiner*—Leonard P. Walnoha
*Attorney, Agent, or Firm*—Weingram & Zall

[57] ABSTRACT

An adjustable railway fastening for securing a bridge girder or cover plate of the girder to a cross-tie on a bridge which includes a resilient clip having a planar body portion with an elongated slotted opening therein for a bolt which is offset with respect to the resilient end engaging bridge girder. The resilient end in the form of a compression arch engages a girder flange to limit vertical movement and a tie-engaging end includes downwardly and outwardly extending ears for laterally restraining the cross-tie. A shoulder on the resilient end also engages a side of the girder flange to further limit lateral movement. In order to provide greater resilience, the arch includes two separate finger portions joined at the base with the body portion to form a U, each of the finger portions having a lip adapted to overlie the girder flange. A plate has an aperture for receiving a bolt and a projecting lug adjacent to the aperture to facilitate securing a bolt tensioning member, i.e., a nut. The clip serves as a large washer to firmly hold the cross-tie as well as the girder when the bolt is inserted through the opening and secured with the nut. The contacting surfaces of the plate and the body portion are serrated. The plate serves to locate the bolt at different points along the length of the slot freely adjusting the length of the fastening.

14 Claims, 3 Drawing Sheets

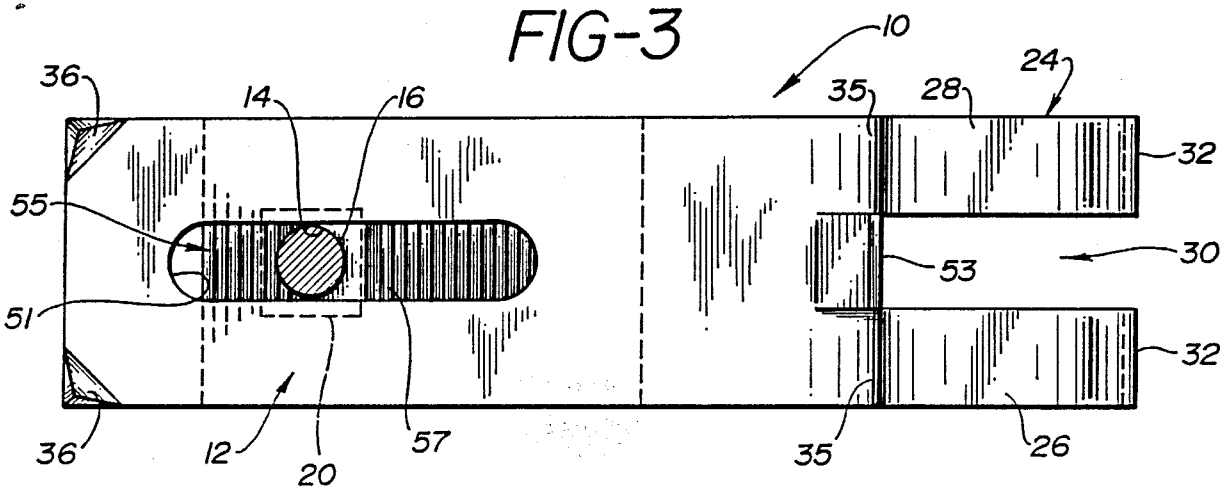
FIG-3
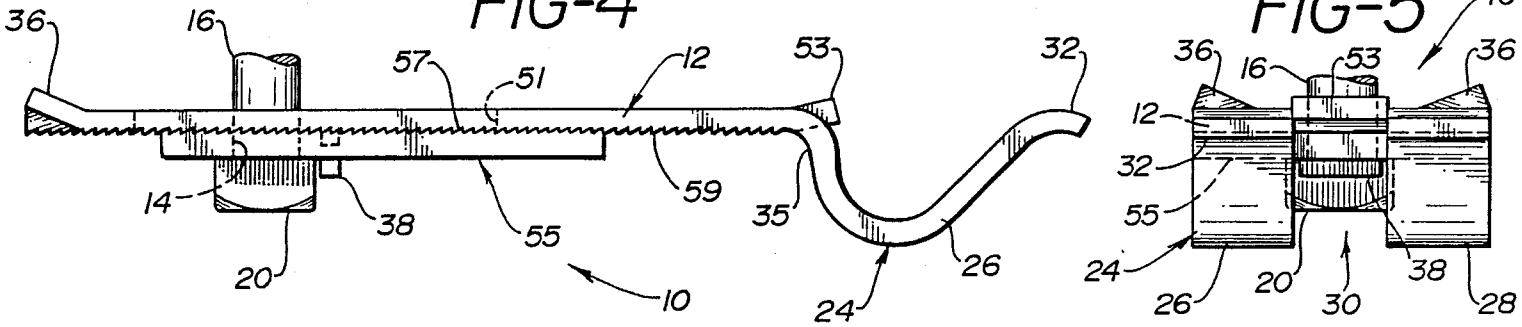
FIG-4
FIG-5

ADJUSTABLE RAILWAY FASTENING

CROSS-REFERENCE TO RELATED APPLICATIONS

This application is a continuation-in-part of application Ser. No. 845,486, filed Mar. 28, 1986, now U.S. Pat. No. 4,687,134, issued Aug. 18, 1987, which is in turn a continuation of application Ser. No. 314,557, filed Oct. 26, 1981, now abandoned.

BACKGROUND OF THE INVENTION

1. Field of the Invention

This invention relates to a railway fastening for use in combination with a railway bridge girder and a cross-tie, and in particular to an adjustable railway fastening in the form of a resilient clip for securely fastening a girder to a cross-tie on a bridge or other supporting structure which provides an ability to vary the location of the fastening bolt and thereby the effective length of the fastener.

2. Description of the Prior Art

Various railway fastenings are described and shown in the prior art but there is a need for a simple reliable railway fastening for securing a girder to a cross-tie on a bridge or other supporting structure.

U.S. Pat. No. 3,552,649 to Burwell shows a railway fastening for resiliently securing a cross-tie on a bridge in the form of an elongated resilient clip of rectangular cross-section. The clip has a flat end bearing portion for engaging the lower face of a tie and an arcuate bearing portion at its opposite end to bear against a bridge girder or cover plate for securing the tie to the girder. The arcuate portion of the clip has an elongated slot extending longitudinally on the clip to receive a bolt having a diameter substantially less than the length of the slot and such as to slidably engage the sides of the slot. This slidable engagement enables the angular position of the clip to be adjusted relative to the bolt to thereby adjust the position of the arcuate bearing portion so that the clip can be used with cover plates or girder flanges of substantially different thicknesses.

While this clip has performed satisfactorily in most situations, problems arise if the size of the steel tie plate that is on top of a wooden tie is increased, so that the steel tie plate is actually wider than the flange of the steel girder underneath the tie. The top tie plate then interferes with drilling a bolt hole to permit the tie to be fastened to the girder flange. It now becomes necessary to move the bolt hole to the side of the girder flange. Consequently, if the bolt is placed outside of the tie plate it will not be next to the girder after passing through the tie and the tie will not be securely fastened. In addition, when the bolt passes through the arcuate portion, care must be taken to avoid excessive tightening of the bolt which can limit the desired resiliency of the clip in securing the girder.

U.S. Pat. No. 3,659,784 shows a bracket for use with a clamp and screw spike adapted to clamp elevated railroad ties to a support structure. The bracket comprises a U-shaped member with a base portion and vertically extending wing portions. The base portion is provided with a washer held in an elongated slot. The washer registers with the nut shaped portion of the screw spike to enable the vertically extending wing portions of the bracket to be positioned for securing to the tie. The bracket prevents the screw spike and clamp from disengaging and falling from the tie.

Other rail fastening devices are shown in U.S. Pat. No. 3,796,369 in which one portion of the fastener overlies the rail flange and the other portion contacts a supporting surface and is secured thereto to resist rotational movement. U.S. Pat. No. 3,362,639 shows another rail fastening that is in the form of a spring clip having a compression arch, a rail flange engaging end, and an intermediate rib provided with a depending rail side edge engaging portion. Tightening of a pressure block disposed above the clip flexes the arch and rib to embrace the rail and inhibit both longitudinal and laterial displacement of the rail.

Another rail fastening in the form of a clip for positioning a rail to a sleeper is shown in U.S. Pat. No. 4,254,909. The clip shown there is a spring plate, shaped so that when retained near its midpoint, one end bears against the upper surface of the rail while the other bears against a sleeper or bearing pad on the sleeper. The slit is urged downwardly against the foot of the rail by a loop extending upwardly from the sleeper and a locking pin passing through the loop and bearing against the intermediate locality of the clip.

The invention of the aforementioned parent application contemplated a resilient clip having a substantially planar body portion with an opening for a bolt which is offset with respect to a bridge girder or cover plate, a girder flange engaging end in the form of a resilient compressions arch to restrain vertical movement, and a tie engaging end having downwardly and outwardly extending ears for laterally restraining the cross-tie. A shoulder on the resilient arch also engages the side of the girder flange to provide further lateral restraint. In effect, the clip resembles a relatively flat spring washer with an arched end which, when a bolt is inserted through the opening and a bolt-tensioning member, such as a nut, is secured to the bolt, presses against the girder flange, while the ears press against the cross-tie to restrain lateral and vertical movement thereof.

SUMMARY OF THE INVENTION

The present invention utilizes the clip of the parent application but modifies same by the addition of a serrated plate cooperating with serrations formed on the planar body and providing a coacting slot in both the body and an aperture in the plate. The bolt is then passed through the aperture and the slot so that adjustment is provided by taking advantage of the position of the bolt in the slot. An additional pair of ears may also be provided at the girder engaging end to provide further lateral restraint of the clip.

It is an object of the invention to provide an improved adjustable railway fastening which is simple in construction and yet which can secure a bridge girder to a cross-tie at a convenient point for the fastening to abut the bridge structure properly and prevent the cross tie from lateral and vertical movement on a bridge or similar structure.

It is a further object of the invention to provide an adjustable railway fastening suitable for use on a bridge supporting structure in which the fastening can be secured to a girder at a convenient point, the fastening having a flat portion engaging the tie to provide lateral and vertical restraint.

A still further object of the invention is to provide a resilient railway fastening device wherein the securing bolt is adjustably displaced from the resilient spring portion to permit securing the fastening device to the tie without limiting the resiliency of the spring portion or interfering with a girder cover plate.

Another object of the invention is to provide an adjustable railway fastening device having coacting serrated surfaces between the device and a leaf spring adjusting plate and including ears adjacent to a shoulder engaging the side of the flange for further lateral restraint.

The objects and advantages of the invention will be more fully described in connection with an illustrative embodiment shown in the drawings.

BRIEF DESCRIPTION OF THE DRAWINGS

FIG. 3 is a top view of the railway fastening device;

FIG. 4 is a side view of the device;

FIG. 5 is an end view of the device.

DESCRIPTION OF THE PREFERRED EMBODIMENTS

Figure 1:
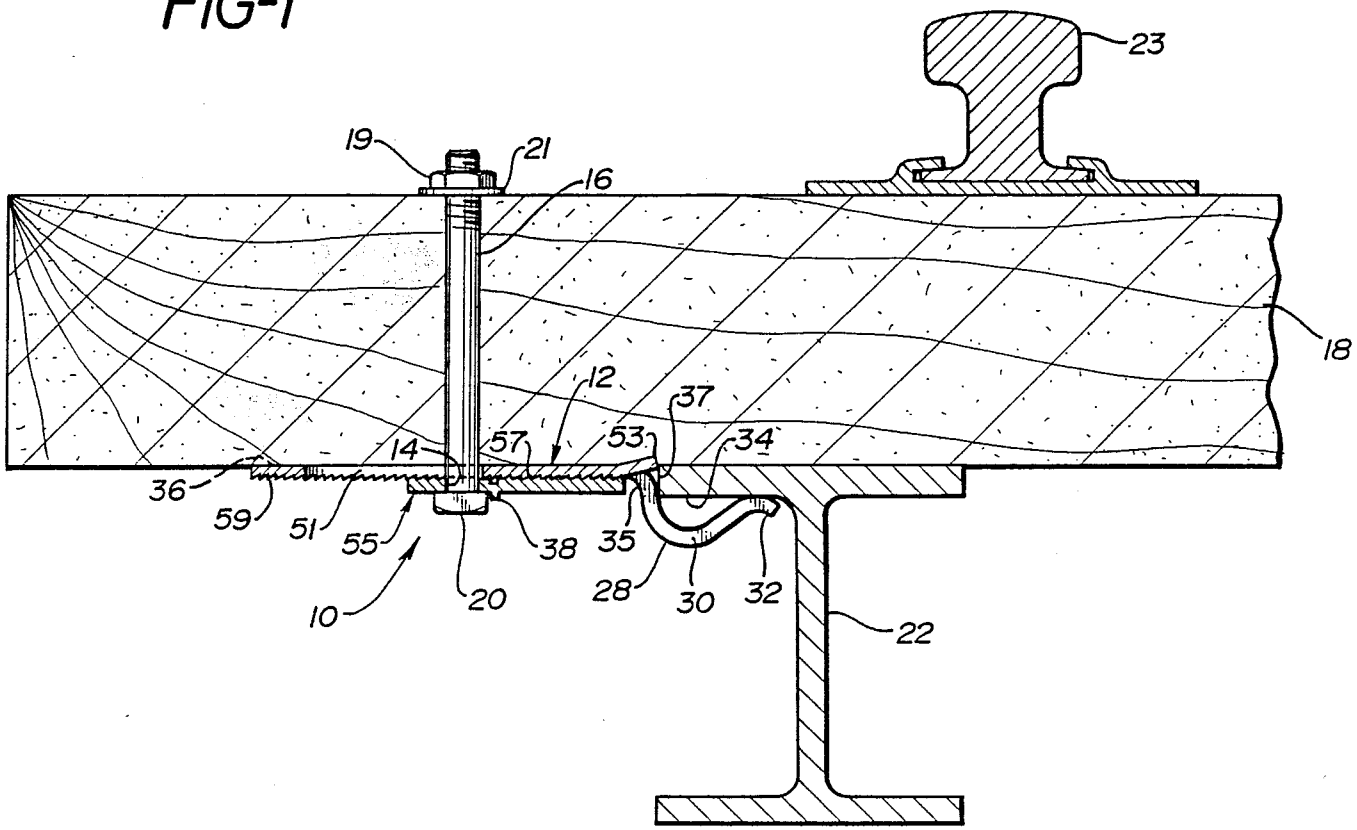
FIG. 1 is a side view in cross-section showing the railway fastening device securing a girder to a cross tie supporting a rail.
Figure 2:
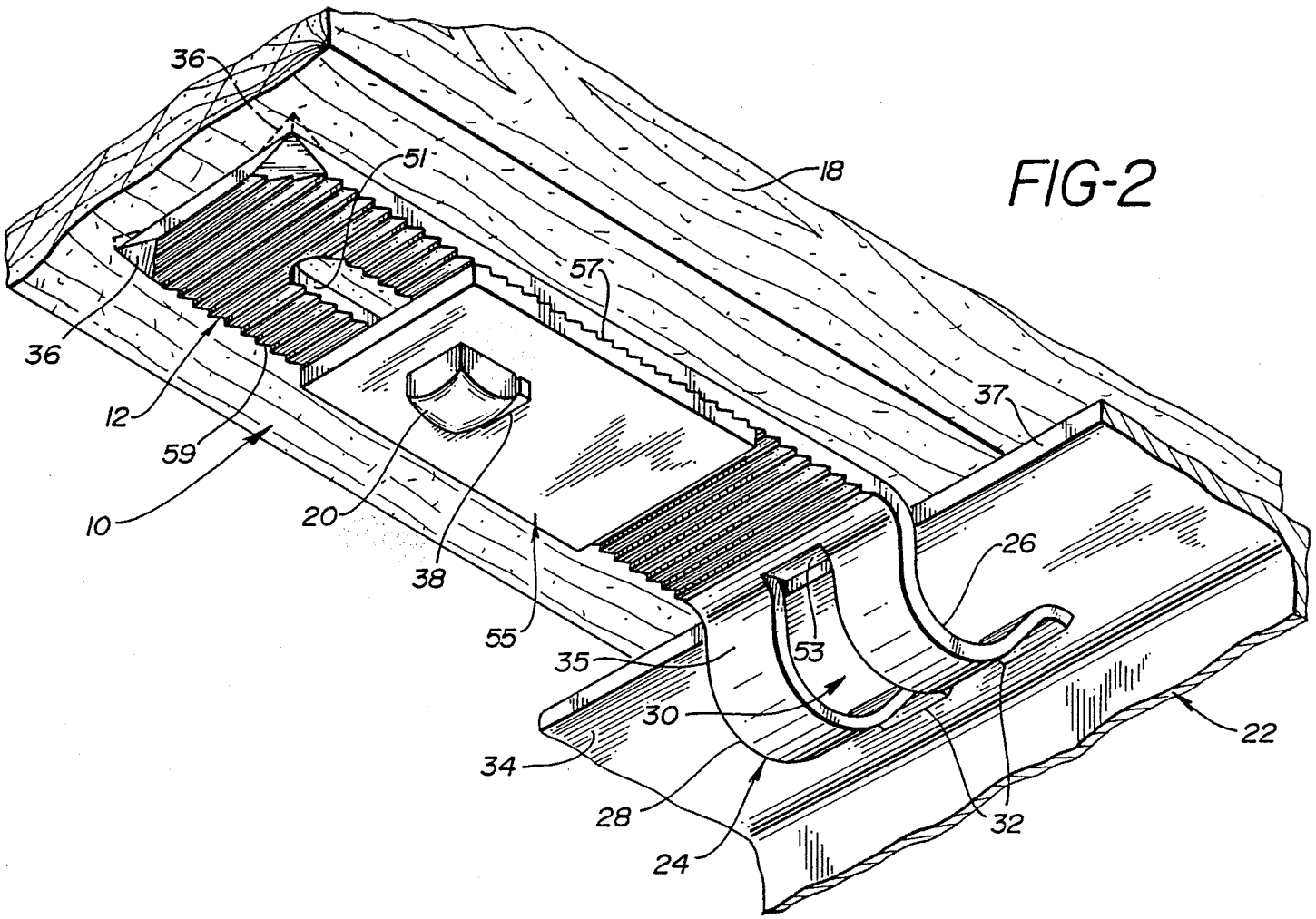
FIG. 2 is an enlarged perspective bottom view showing the railway fastening device securing a girder flange to a cross tie.

As shown in FIGS. 1 and 2, the railway fastening 10 is in the form of a substantially planar clip having a curved end. The main flat body portion 12 includes an oval slot 51, shown more clearly in FIGS. 2 and 3, for receiving a bolt 16 for securing the clip to a cross-tie 18. The head 20 of the bolt is prevented from turning by lug 38 and is secured by a nut 19 and washer 21. The curved end engages a girder 22 which supports a rail 23 secured on the cross-tie 18.

The curved end of the clip holding the girder is in the form of a compression arch 24, which arch engages the beam to prevent lateral movement of the cross-tie, as shown in FIGS. 1, 2 and 4, which has two finger-like portions 26 and 28, shown in FIGS. 2, 3 and 5, joined at the base to the body portion 12 and forming a U-shaped notch 30. Each of the finger-like portions has a lip 32 which overlies the horizontal girder flange 34.

The clip, including the compression arch, is made of a relatively thin sheet of material, such as steel, which is resilient. The arch may be of one piece but preferably, as shown, is formed by two separated fingers to provide added resilience. Thus, when the bolt is tightened, the flat portion of the clip presses against the cross-tie, and tee arch resiliently grips the girder flange. An inner shoulder 35 and outwardly extending ear or tabs 53 of the arch also engage the side edge 37 of the flange and grip the cross-tie, respectively, to provide restraint.

At the other end of the body portion 12 are two upwardly and outwardly extending ears or tabs 36 which, when nut 19 and bolt 16 is tightened, grip the cross-tie, restraining lateral and vertical movement thereof, as well as longitudinal movement.

A support plate 55 having a serrated side 57 has a projecting lug 38 on the plate adjacent to the bolt aperture 14 which permits the nut 20 to be tightened on the bolt with a single wrench while preventing the bolt from turning, and thus, simplifies fixing the clip in position.

Serrated side 57 coacts with serrations 59 on portion 12. The adjustment is provided by the ability of the plate to engage the body at different points defined by the length of slot 51.

The offset of the bolt opening 14 from the girder flange 34 and resilient fingers 26 and 28 permits use of various sized girders and cover plates without interference from the bolt. In addition, the resilient spring action permits some vertical movement while firmly holding the girder in position against the ties without a fixed limit as in the case where the bolt passes through the resilient end. The bolt, shoulder of the curved resilient end, and ears at the opposite end all cooperate in limiting lateral movement of the girder and ties, and the bolt can be tightened fully directly on the washer-like flat portion of the fastening device against the ties to secure the elements together.

The use of two spring fingers separated by the notch provides a desired degree of resilience for maximum contact of the shoulder with the side of the flange. The curved lip at the ends of the spring fingers also applies the force more uniformly across the girder flange and avoids the stiffness of a sharper edge.

The present invention thus provides an improved simplified railway fastening device which is adaptable to various supporting structures. While the invention has been described in connection with a specific embodiment, it is apparent that many variations may be made in the particular design and configuration without departing from the scope of the invention as set forth in the appended claims.

What is claimed is:

1. A railway fastening for use in combination with a cross-tie and a supporting girder having a flange comprising:

a resilient clip including a longitudinal substantially planar body portion having an elongated opening to receive a bolt extending through the cross-tie, an end spaced from said opening and engageable with the flange of the supporting girder and another end engageable with the cross-tie;

a compression arch in said end spaced from said opening for resiliently engaging said flange, said arch includes a shoulder portion adapted to engage a side of said flange, to laterally restrain said cross-tie;

a pair of ears in the tie engaging end to laterally restrain the cross-tie;

means to tension said bolt to resiliently secure said clip to said cross-tie and said flange; and means adjustably coupled to said body to locate said bolt at different points in said elongated opening.

2. The fastening of claim 1 wherein said adjustably coupled means includes a plate having an opening therein for receiving the bolt, said plate contacting a surface of said body.

3. The fastening of claim 2 further including complementary serrations on the body and the plate for enhancing contact between the body and the plate.

4. The fastening of claim 3 wherein said plate includes a projecting lug located adjacent said opening for securing said bolt.

5. The fastening of claim 1 further including a second pair of ears formed in proximity to said shoulder portion to provide further lateral restraint of said cross-tie.

6. A railway fastening as claimed in claim 1 wherein said arch has a lip portion adapted to overlie and engage said flange.

7. A railway fastening as claimed in claim 1 wherein said arch includes two separated finger-like portions joined at the base to form a U.

8. A railway fastening as claimed in claim 5 wherein said pairs of ears project outwardly and downwardly from said tie-engaging end and said shoulder portion, respectively.

9. A railway fastening for use in a bridge tie anchor comprising:

a resilient clip including a substantially planar body portion having an elongated slotted opening therein for receiving a bolt extending through a cross-tie, a bridge girder flange engaging end, and a tie-engaging end, said opening being spaced from said flange engaging end;

means overfitting said elongated opening for adjustably guiding a bolt to different locations within said opening;

a compression arch in said flange engaging end for resiliently engaging said flange, said arch includes a shoulder portion adapted to engage a side of said flange to laterally restrain said cross-tie;

a pair of ears in said tie-engaging end to laterally restrain said cross-tie;

a projecting lug adjacent said opening in the body portion to prevent movement of said bolt during tensioning thereof; and means to tension said bolt to resiliently secure said tie end and said flange.

10. A railway fastening as claimed in claim 9 wherein said overfitting means comprises a flat plate having an opening therein for receiving a bolt, and a projecting lug adjacent said opening for securing a bolt.

11. A railway fastening as claimed in claim 10 wherein said flat plate and said body portion are each serrated so that contact between them will be enhanced.

12. The combination of a wooden tie resting on a girder, an elongated resilient clip having a flat bearing portion engaging the lower face of said tie, said flat bearing portion having projections at one end embedded in said tie and a bolt receiving slot through said flat portion and tie, said clip having an arcuate portion at the opposite end spaced from said hole for resiliently engaging a flange of said girder, a bolt passing through said aperture in said plate and said slot in said flat portion and tie, means for tensing said bolt to resiliently secure said clip to said tie and flange, and an apertured plate mounted in contact with said flat bearing portion, said aperture aligned with a portion of said slot.

13. The combination of claim 12 wherein the contacting surfaces of said plate and bearing portion are serrated.

14. The combination of claim 12 wherein said plate includes a lug extending adjacent said aperture for engaging said bolt.

* * * * *